US010308478B2

(12) United States Patent
Mäkilaurila et al.

(10) Patent No.: US 10,308,478 B2
(45) Date of Patent: Jun. 4, 2019

(54) ELEVATOR SYSTEM RECOGNIZING SIGNAL PATTERN BASED ON USER MOTION

(71) Applicant: KONE CORPORATION, Helsinki (FI)

(72) Inventors: Sampo Mäkilaurila, Helsinki (FI); Harri Länsiö, Hyvinkää (FI); Timo Mertanen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 269 days.

(21) Appl. No.: 15/264,255

(22) Filed: Sep. 13, 2016

(65) Prior Publication Data

US 2017/0001830 A1 Jan. 5, 2017

Related U.S. Application Data

(63) Continuation of application No. PCT/EP2014/055147, filed on Mar. 14, 2014.

(51) Int. Cl.
*B66B 1/34* (2006.01)
*B66B 1/46* (2006.01)

(52) U.S. Cl.
CPC ..... *B66B 1/468* (2013.01); *B66B 2201/4615* (2013.01); *B66B 2201/4638* (2013.01); *B66B 2201/4653* (2013.01); *B66B 2201/4676* (2013.01)

(58) Field of Classification Search
USPC ..... 187/247
See application file for complete search history.

(56) References Cited

U.S. PATENT DOCUMENTS

| | | | | |
|---|---|---|---|---|
| 7,706,452 | B2 * | 4/2010 | Fujita | G01S 13/931 375/259 |
| 7,819,230 | B2 * | 10/2010 | Gerstenkorn | B66B 3/00 187/391 |
| 2008/0256494 | A1 * | 10/2008 | Greenfield | G06F 3/0304 715/863 |
| 2012/0168262 | A1 * | 7/2012 | Finschi | B66B 1/467 187/392 |
| 2012/0234631 | A1 | 9/2012 | Hsieh | |

FOREIGN PATENT DOCUMENTS

| | | | |
|---|---|---|---|
| CN | 101610963 | A | 12/2009 |
| CN | 102216186 | A | 10/2011 |
| CN | 102292277 | A | 12/2011 |
| CN | 202766056 | U | 3/2013 |
| JP | 2007-221698 | A | 8/2007 |
| JP | 2008-63053 | A | 3/2008 |
| JP | 2012-122206 | A | 6/2012 |

* cited by examiner

*Primary Examiner* — Christopher Uhlir
(74) *Attorney, Agent, or Firm* — Birch, Stewart, Kolasch & Birch, LLP

(57) ABSTRACT

An elevator system includes a destination control system and an input system. An elevator car is called by an identification-device of a passenger being read by the input system. The destination control system is designed to recognize a signal-pattern that is produced by the passenger moving the respective identification device relative to parts of the input system. The destination control system is programmed to process different programs depending on the signal-pattern. Furthermore, a method for biasing elevator movements of such elevator systems is disclosed.

12 Claims, 2 Drawing Sheets

ELEVATOR SYSTEM RECOGNIZING SIGNAL PATTERN BASED ON USER MOTION

FIELD OF THE INVENTION

Figure 1:
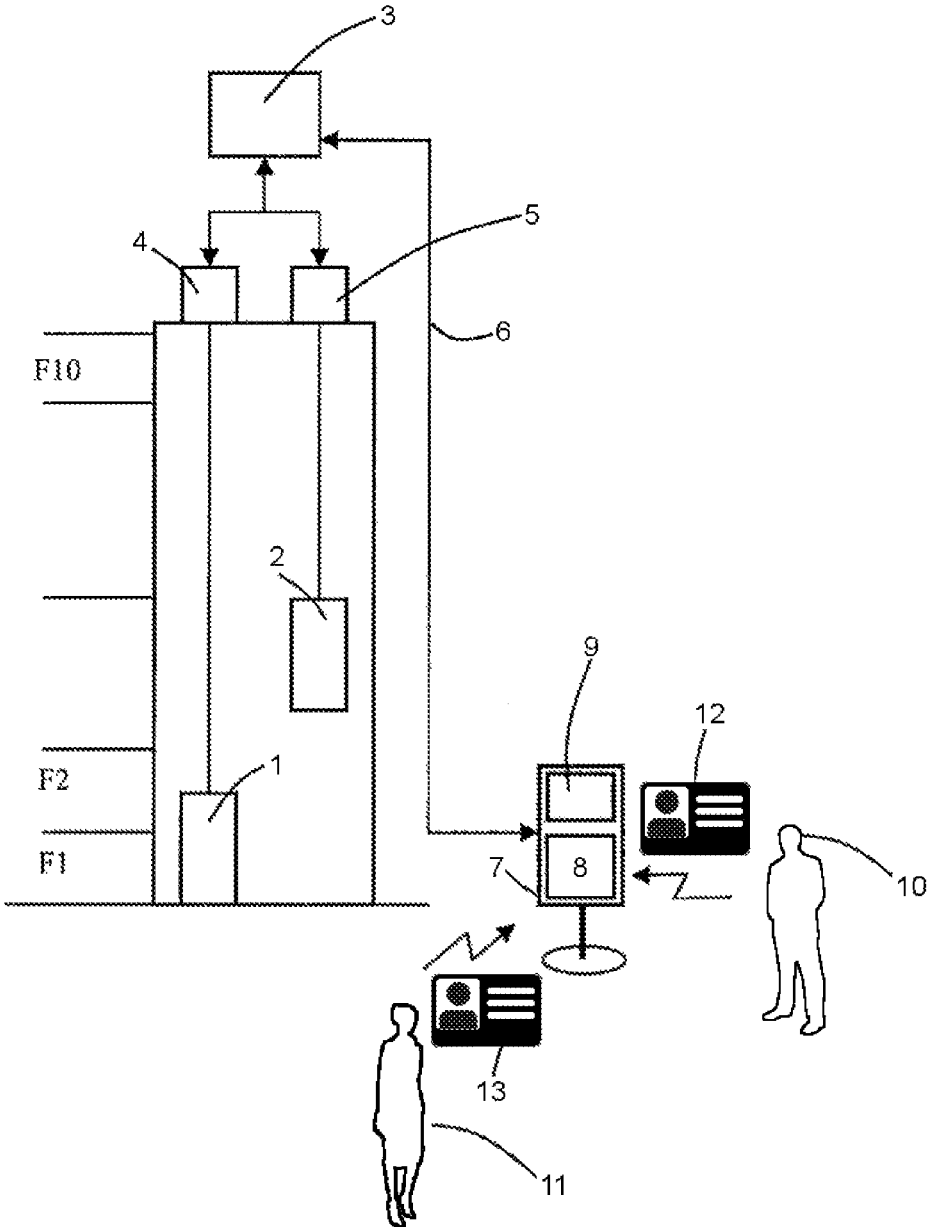

The invention relates to a method for biasing elevator car movements, especially time-defined actions concerning access points of elevator systems. More particularly the invention relates to the call allocation and related information for elevator systems with a destination control system. The invention further relates to elevator systems that are designed to execute such a method.

BACKGROUND OF THE INVENTION

Known in the art are elevator systems comprising a so called "destination control system". This system controls the destinations and/or movements of elevator cars following a program that has been loaded or programmed into this destination control system. Since the destination control system may prevent several destinations to be reached by certain elevator cars for certain passengers, destination control systems are often equipped with a "direct call option", which is an option to override the destination control system and offering a possibility to choose the destination manually.

Often, an elevator system comprising a destination control system does not only provide a possibility to choose a direction directly by hand. These systems generally provide turnstiles or access points integrated in the destination control system, where passengers input individual codes for identification (e.g. via ID-cards or RFID-tags).

In prior art, where the destination control system provides a direct call option by means of for example an identification code, there appears the problem that the manual programming is very time-consuming and not user-friendly. For example, there is a prior art solution where a passenger puts his ID card into a reader of the call panel of the elevator system, then the call panel starts to count floor by floor by displaying or reading the respective floor number, and when the ID card is removed a call to the last indicated floor is generated. In addition that this method is very slow and not user friendly, there is the possibility to produce false calls, if the ID-card is moved too early or too late.

Document US 2012/0168262 Al deals with a method for allocating an elevator car, such, that a passenger can emit a signal by aid of a mobile device which signal changes the elevator status to an operating mode enabling its use by disabled persons.

AIM OF THE INVENTION

The aim of the present invention is to disclose a solution, which eliminates or at least alleviates the drawbacks occurring in prior-art solutions presented above, and to enable a person to easily activate different programs of a destination control system, while the possibility of wrong inputs is reduced.

It is also an aim of the invention to disclose an elevator system which is optimized in regard to the prior art.

SUMMARY OF THE INVENTION

The elevator method according to the invention and preferred embodiments are characterized by the claims. Some further inventive embodiments are also presented in the descriptive section and in the drawings of the present application. The features of the various embodiments of the invention can be applied within the scope of the basic inventive concept in conjunction with other embodiments.

The invention refers to an elevator system comprising a destination control system and an input system, wherein an elevator car is called by an identification-device of a passenger being read by the input system. The system is designed to recognize signal-pattern that are produced by the passenger moving the respective identification device relative to parts of the input system and the destination control systems is programmed to process different programs depending on said signal-pattern.

The method for biasing elevator car movements according to the invention is based on an elevator system comprising a destination control system and an input system, wherein an elevator car is called by an identification-device of a passenger being read by the input system. The method is characterized in that the destination control system recognizes signal-pattern that are produced by the passenger moving the respective identification device relative to parts of the input system and the destination control system is programmed to process different programs depending on said signal-pattern.

The destination control system preferably comprises processing devices. Suitable processing devices are able to process passenger data, allocate a destination to an elevator car of the elevator system as used by the respective passenger, call this elevator car to the position of the respective passenger and direct the elevator car to the destination allocated by the passenger. Preferred processing devices are computers or at least an assembly of certain components of a computer, microcontrollers or virtual environments in a computer system.

The input system according to the invention comprises at least one input device being designed to measure or read suitable identification devices that are used to identify passengers in the elevator system. Optionally, the input system also comprises devices to block access to the elevator. In a preferred embodiment, the input system comprises access points and/or turnstiles.

Preferred identification devices are electronically readable ID-cards, RFID-tags, barcodes, mobile phones or biometrical unique parts of the human body (e.g. fingerprints, retina).

Preferred input devices are able to identify a person entering the building or at least intending to use an elevator of the elevator system, and especially comprise input means. Preferred input means are manual devices, ID-readers (e.g. card readers, barcode readers or RFID-terminals), visual devices (e.g. cameras with face-identification capabilities), biometric scanners (e.g. fingerprint-readers, face recognition-devices and retina-measurement devices) or receivers for mobile-phone-messages.

Signal-pattern are pattern consisting of signals that may be similar or different. Although, the shortest possible pattern consists of one single signal, the method is configured to process pattern consisting of more than one signal or at least two pattern consisting of different signals. Preferred signal-pattern are pattern comprising short- and/or long-time signals.

Preferably, the signals are produced via motions of the identification device relative to an input device of the input system, such as swipes, contacts, or other movements to and from a position where the identification device may be measured. Since there are pauses between two signals, the time length of one signal and/or the pause between two signals or a group of signals may indicate whether the respective signal or group of signals is to be interpreted as a "long signal" or as a "short signal". For Example, signal-pattern may be comparable to letters of Morse-code, with short and long time signals or may be comparable to 'clicks' and 'double clicks' of a computer mouse. Even signal pattern that may be comparable with swipe-motions of a touchscreen are preferred.

As listed in the following table, certain pattern may produce certain requests in the destination control system. In this example, there are certain "home floors" programmed. Home floors may be the work space, the cantina, the underground parking. In this example, the elevator system also provides the possibility of long door opening times so that handicapped persons have enough time to enter or leave the elevator car.

| Pattern of Signals | Request |
|---|---|
| Short | Destination call to first "home floor" 1 |
| Long | No call (manually give from call panel) |
| Short - short | Call to second "home floor" (e.g. cantina) |
| Short - short - short | Call to third "home floor" (e.g. parking) |
| Long - short | Call to first "home floor" 1 with long door open time |
| Long - short - short | Call to second "home floor" with long door open time |
| etc . . . | . . . |

Surely, the call signal for long opening times may also be programmed to occur at the end of the short signals (Short-short-long for the second "home floor" with long door open time) in another preferred embodiment.

It should be regarded that the above example of Morse-code normally deals with words or texts consisting of more than one letter per transmission. Due to the long/short silences between the dots and dashes of morse-messages and the dots/dashes themselves, the receiver can be synchronized to the length of the dots and dashes while transmitting with different speed. If only one dot/dash is transmitted, the receiver may have difficulties to recognize if the signal has to be interpreted as a dot or as a dash.

Therefore, in a preferred embodiment, the time-length of short and long signals is defined thus, that a human can easily input correct signals automatically without the need to use a watch or other means. To achieve that, the short signals are preferably defined to be signals produced by a fluid motion (e.g. a swipe or a fluid inserting/extracting-motion) of the respective identification device, and the long signals are defined to be produced by non-fluid motions (an active pause during the motion, especially in its middle) of the respective identification device.

In another preferred embodiment the input system comprises display means where a feedback concerning the signals of the passenger is given. Preferably these display means are recognizable from a person standing at an input device, and are especially attached to the input device. These display means are indicating the signals entered by the passenger or at least the last entered signal, and are preferably displays or LEDs.

In a preferred embodiment the short signal is at least one second shorter than the long signal, especially at least two seconds shorter than the long signal. The time-period of a short signal lies especially between 0.1 and 2 seconds, preferably between 0.5 and 1.5 seconds.

In a preferred embodiment the long signal is at least two times longer than the short signal, especially at least 3 times longer.

In another preferred embodiment, the long signal has not a longer total time period compared to the short signal but consists of two (or more) short signals following swiftly each other (like a double-click entered with a computer mouse). The time between this sequence of short signals indicates if these are separate short signals following each other or one long signal. In a preferred embodiment, a long signal is recognized by the system, when the pause between two short signals is shorter than two times the defined length of short signal, especially shorter than the length of one short signal.

Above it is said that the destination control system is programmed to process different programs depending on said signal-pattern. This means that the destination control system comprises at least two different programs that can be chosen by inputting said signal pattern. In a preferred embodiment, at least two of these programs are assigned to—and applicable by—at least one of the potential passengers of the elevator system or a group of these passengers. There may be programs that can only be chosen by few passengers (e.g. management) or by all possible passengers. It is even preferred that the same signal-pattern executed with different identification devices will address different programs in the destination control system, so that with a single swipe of the ID, the CEO will reach the floor of the right office and the worker will reach the right floor of the working space. Thus, the program activated by a performed signal pattern preferably depends on the identification device the signal pattern is performed with.

Part of this invention are also computer programs that are based on the method of this invention, especially computer programs on computer readable media (e.g. storage media, random access memories or informations hardwired in hardware).

LIST OF FIGURES

In the following, the invention will be described in detail by the aid of examples of its embodiments, wherein:

FIG. 1 presents an elevator system suitable for the method of the present invention.

Figure 2:
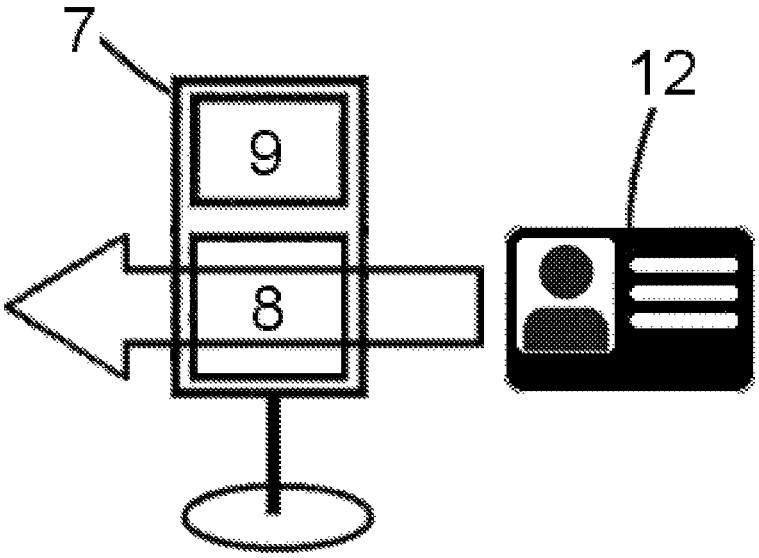

FIG. 2 demonstrates a fluid motion of an ID-device.

Figure 3:
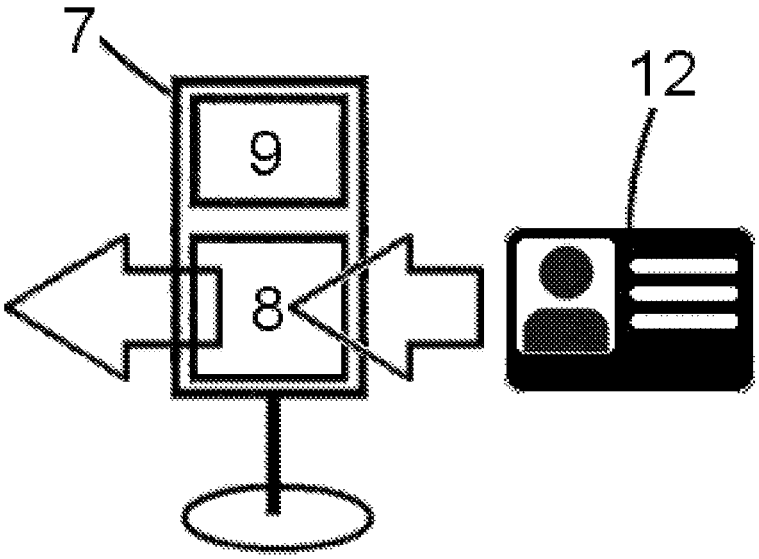

FIG. 3 demonstrates a paused motion of an ID-device.

DETAILED DESCRIPTION OF THE INVENTION

FIG. 1 presents an elevator system suitable for the method of the present invention. The elevator system forms an elevator group, which comprises two elevator cars 1 and 2, the elevator cars 1 and 2 are able to move in the elevator hoistway between the floors F1, F2 . . . F10. The elevator system is operated by processing device 3 of a destination control system that moves elevator car 1 via motor unit 4 and elevator car 2 via motor unit 5. In addition, processing device 3 receives signals over a data line 6 from an input device 7 of the input system that are mounted at least on the ground floor, but preferably also in any lobby of floors 1 to 10. Every destination device 7 comprises input means 8 to identify an identification device, and optionally a display 9 to show the addressed program.

In the figure, two persons are shown wherein persons 10 and 11 each have an individual ID card 12/13 to input signals into the input device 7.

Possible ways to input different signals for a signal pattern in the input device 7 using an ID card 12 as identification device are shown in FIGS. 2 and 3. It is clear that the same actions can be accomplished with ID-card 13 or any other ID-card as well.

The ID card is moved in front of input means 8 as indicated by the arrows in FIGS. 2 and 3, and read by the input means 8 when the ID-card 12 is in front of this input means 8. The continuous arrow in FIG. 2 indicates that ID-card 12 is moved in a fluid motion, the two arrows in FIG. 3 indicate that there is made a short pause over the input means 8.

In this example of FIG. 2, the fluid motion (with a relatively short time of the ID-card 12 over the input means 8) is interpreted as a short signal, and the paused motion in FIG. 3 with a longer time of the ID-card 12 over the input means 8 is interpreted as a long signal.

While performing motions as shown in FIGS. 2 and 3, persons 10 and 11 are able to input signal pattern in the input system and activate programs that are assigned to the respective input pattern. The chosen programs (or the destinations reached with these programs or the special functions activated with these programs) could be indicated on display 9.

For example if ID-card 12 is shown one second to the input means, direct pre-saved call to floor 10 is given, if ID-card 13 is shown one second to the input means, direct pre-saved call to floor 2 is given. If ID-card 12 is shown three seconds to the input means 8, person 10 can access a direct call option that is part of the program of the destination control system. If ID-card 12 or 13 is shown three seconds to the input means 8 and after that again for one second, direct pre-saved call to floor 1 (maybe the cantina) is given.

REFERENCE SIGNS

1 & 2 elevator cars
3 processing device
4 & 5 motor units
6 data line
7 identification device
8 input means
9 Display
10 & 11 persons
12 & 13 ID-cards

The invention claimed is:

1. A method for biasing elevator movements of an elevator system, the elevator system comprising a destination control system and an input system, said method comprising the steps of:

calling an elevator car by an identification device of a passenger being read by the input system;

recognizing a signal-pattern produced by a passenger moving a respective identification device relative to parts of the input system; and the destination control system processing different programs depending on said signal-pattern, wherein the signal-pattern comprises at least one short and at least one long signal, and wherein the at least one short and at least one long signals are produced via different respective motions of the identification device relative to an input device of the input system;

wherein a time-length of short and long signals is defined such that a person inputs correct signals without the need to use another means; and wherein the at least one short signal is defined to be a signal produced by a fluid motion of the respective identification device, and the at least one long signal is defined to be produced by non-fluid motions of the respective identification device.

2. The method as claimed in claim 1, wherein a length of one signal and/or a pause between two signals or a group of signals indicate whether the respective signal or group of signals is to be interpreted as a long signal or as a short signal.

3. The method as claimed in claim 1, wherein a time-period of a short signal lies between 0.1 and 2 seconds, and wherein the short signal is at least one second shorter than a long signal and/or the long signal is at least two times longer than the short signal.

4. The method as claimed in claim 1, wherein the at least one long signal comprises at least two short signals following each other, wherein the time between the sequence of short signals indicates if the signals are separate short signals following each other or one long signal, and wherein a long signal is recognized by the elevator system, when the time between two short signals is shorter than two times a defined length of one of the two short signals.

5. A computer program embodied on a non-transitory computer readable medium and comprising computer program code configured to carry out the method of claim 1.

6. The method as claimed in claim 1, wherein the motions of the identification device relative to the input device of the input system include swipes, contacts, or movements to and from a position where the identification device is measured.

7. The method as claimed in claim 2, wherein a time-period of a short signal lies between 0.1 and 2 seconds, and wherein the short signal is at least one second shorter than a long signal and/or the long signal is at least two times longer than the short signal.

8. The method as claimed in claim 2, wherein the at least one long signal comprises at least two short signals following each other, wherein the time between the sequence of short signals indicates if the signals are separate short signals following each other or one long signal, wherein a long signal is recognized by the elevator system, when the time between two short signals is shorter than two times a defined length of one of the two short signals.

9. The method as claimed in claim 3, wherein the at least one long signal consists comprises least two short signals following each other, wherein the time between the sequence of short signals indicates if the signals are separate short signals following each other or one long signal, wherein a long signal is recognized by the elevator system, when the time between two short signals is shorter than two times a defined length of one of the two short signals.

10. A computer program embodied on a non-transitory computer readable medium and comprising computer program code configured to carry out the method of claim 2.

11. A computer program embodied on a non-transitory computer readable medium and comprising computer program code configured to carry out the method of claim 3.

12. A computer program embodied on a non-transitory computer readable medium and comprising computer program code configured to carry out the method of claim 4.

* * * * *